US005352099A

United States Patent [19]

Anstine et al.

[11] Patent Number: 5,352,099

[45] Date of Patent: Oct. 4, 1994

[54] EXHAUST FAN FOR WATER HEATER

[75] Inventors: William E. Anstine, North Canton; Gregory P. Wagner; Michael P. Conner, both of Uniontown, all of Ohio

[73] Assignee: Ametek, Inc., Kent, Ohio

[21] Appl. No.: 990,667

[22] Filed: Dec. 14, 1992

[51] Int. Cl.[5] ..... F04B 17/00

[52] U.S. Cl. ..... 417/366; 417/423.14; 122/17; 126/312

[58] Field of Search ..... 417/366, 367, 423.1, 417/423.8, 423.14; 122/17; 110/162; 454/16; 126/30, 312, 389

[56] References Cited

U.S. PATENT DOCUMENTS

| | | | |
|---|---|---|---|
| 2,188,741 | 1/1940 | Roberts | 417/423.1 |
| 3,542,496 | 11/1970 | Bergeson et al. | 417/423.1 |
| 4,225,292 | 9/1980 | Hallerbäck et al. | 417/367 |
| 5,205,725 | 4/1993 | Pattison | 417/423.14 |

*Primary Examiner*—Richard A. Bertsch
*Assistant Examiner*—Alfred Basichas
*Attorney, Agent, or Firm*—Renner, Kenner, Greive, Bobak, Taylor & Weber

[57] ABSTRACT

An exhaust fan assembly for implementation with a hot water tank. The assembly includes a generally elliptical housing having a large end maintaining a fan and a smaller opposite end having an exhaust port. The fan is rotatable about a vertical axis and is positioned to be maintained over the exhaust vent of a hot water tank. The configuration of the housing as such is to be received between the inlet and outlet pipes of the hot water tank. A motor cup is press fit onto a lid which is formed as a portion of the housing on a top portion thereof, while a cover plate is press fit or snap fit into a circumferential flange about a bottom portion of the housing. The cover plate has an aperture therein in alignment with the fan to allow the fan to communicate with the flue pipe of the hot water tank. The cover plate and housing define a cavity within which the fan rotates, while further defining a path for movement of the exhaust gases and motor venting air to the exhaust port. The exhaust port and motor and fan axes are vertical and parallel to each other. A cylinder defined by the fan and a cylinder defined by the tubular exhaust port are preferrably parallel and non-intersecting.

16 Claims, 1 Drawing Sheet

EXHAUST FAN FOR WATER HEATER

TECHNICAL FIELD

The invention herein resides in the art of dynamo-electric deuces and, more particularly, to fans. Specifically, the invention pertains to an exhaust fan for the flue vent of a hot water heater.

BACKGROUND ART

Gas fired water heaters or tanks are quite well known. In such units, cold water, or water at ambient temperature, is introduced into the tank through an intake pipe and heated by a gas burner. The heated water is then passed from the tank through an output pipe upon demand. In the prior art, flue gasses from the tank burner have been emitted at elevated temperatures, requiring high temperature exhaust pipes such as those provided by steel or fire brick chimneys. The elevated temperature of the flue gases provided for the exhaust thereof. The natural rise of the hot flue gases, coupled with the draw or draft provided by the chimney assured the exhausting of the burner gases from the hot water tank and from the building in which it was maintained.

Presently, power venting high efficiency hot water tanks have become quite common. In such units, the temperature of the flue gases is low. Indeed, the flue gas temperature is so low that the exhaust gases can be passed through plastic or PVC pipe and through the wall of the associated building, rather than up a chimney or other elevated exhaust pipe. Not only was the efficiency of hot water heaters increased with such prior art units, but the exhausting of the flue gases was greatly simplified and the incident costs reduced. However, the reduced temperatures of the exhaust gases, coupled with the absence of an elevated chimney or exhaust pipe has generally resulted in the necessity of the inclusion of an exhaust fan to assure that the exhaust gases or fumes are drawn from the burner and expelled through the plastic pipe to the exterior of the building.

Previously known exhaust fans for hot water heaters have been complex in structure, inefficient in use, and expensive to manufacture and purchase. Typically, prior art exhaust fans for hot water tanks and similar burners have not provided for a fan which is axially aligned with the exhaust flue. Typically, the fan has been horizontally mounted above the hot water tank for communication with the flue through a shroud or vent positioned thereover. Additionally, the prior art has typically taught the use of a separate motor cooling fan for such assemblies, rather than allowing the exhaust fan to serve as the motor cooling fan as well. Additionally, prior art exhaust fans of the type under consideration have not been configured or contained in a housing readily adapted to be received between the input and output water pipes and over the exhaust flue or vent.

There is a need in the art for an exhaust fan for water heaters which eliminates the problems of the prior art noted above.

DISCLOSURE OF INVENTION

In light of the foregoing, it is a first aspect of the invention to provide an exhaust fan for a water heater wherein the fan has the same vertical orientation as the exhaust flue, being rotatable about a vertical axis in substantial alignment with the flue.

Another aspect of the invention is the provision of an exhaust fan for a water heater wherein the fan and motor axe in a single housing that communicates with the exhaust flue, such housing serving as a shroud or hood for the flue.

A further aspect of the invention is the provision of an exhaust fan for a water heater which obviates the need for a separate motor cooling fan.

Still a further aspect of the invention is the provision of an exhaust fan for a water heater which is of increased efficiency and lower cost than those provided in the prior art.

Yet an additional aspect of the invention is the protrusion of an exhaust fan for a water heater in which the motor cooling air is mixed and exhausted with the flue gases, serving to additionally lower the temperature of the flue gas.

An additional aspect of the invention is the provision of an exhaust fan for a water heater which is configured to be received between the inlet and outlet water pipes of the water heater, while having the fan thereof appropriately positioned over the exhaust flue.

Still a further aspect of the invention is the provision of an exhaust fan for a water heater which is configured to accommodate various orientations of mounting with respect to the exhaust flue.

Another aspect of the invention is the provision of an exhaust fan for a water heater wherein the fan does not intersect the tubular exhaust port of the assembly, increasing the efficiency and effectiveness thereof.

The foregoing and other aspects of the invention which will become apparent as the detailed description proceeds are achieved by an exhaust fan assembly for hot water tanks, comprising: a housing adapted to be positioned above a flue pipe of the water tank; a fan received within said housing at a first end thereof, said fan being rotatable about a vertical axis when said housing is so positioned above a flue pipe; and an exhaust port extending from said housing at a second end thereof opposite said first end.

Other aspects of the invention which will become apparent herein are attained by an exhaust fan assembly for a hot water tank, comprising: an elliptical casing having a first larger end and a second smaller end; a fan received within said first end and rotatable about a first vertical axis; an exit port extending from said second end about a second vertical axis; and a motor connected to said fan, said fan being interposed between, and axially aligned with, said motor and an intake aperture of said casing.

DESCRIPTION OF DRAWING

For a complete understanding of the objects, techniques, and structure of the invention, reference should be made to the following detailed description and accompanying drawing wherein.

BEST MODE FOR CARRYING OUT THE INVENTION

Figure 1:
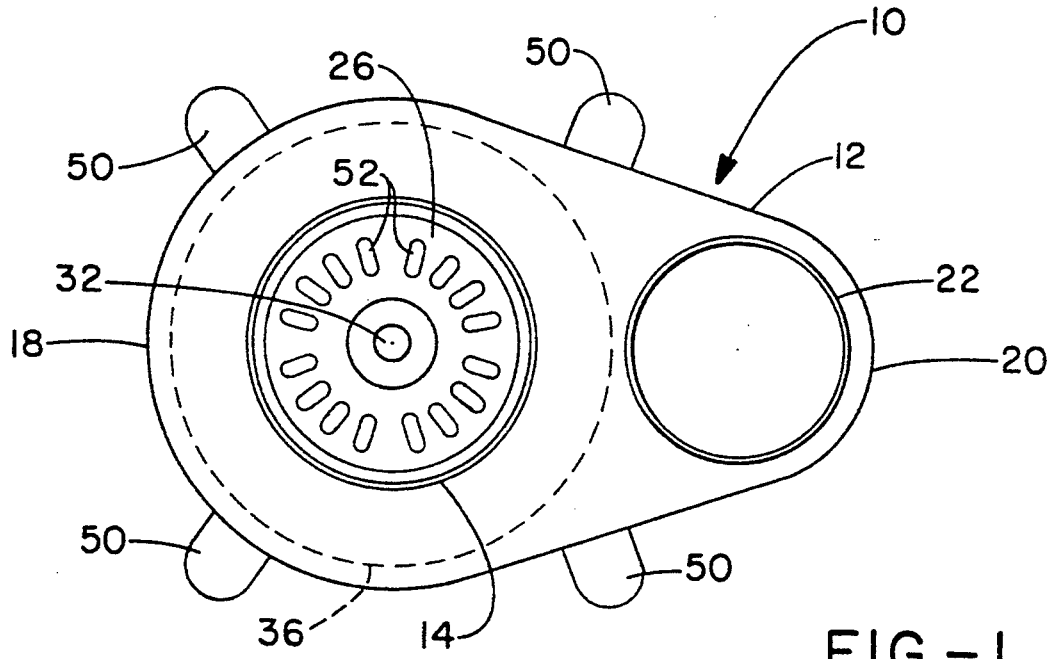
FIG. 1 is a top plan view of the exhaust fan assembly of the invention.
Figure 2:
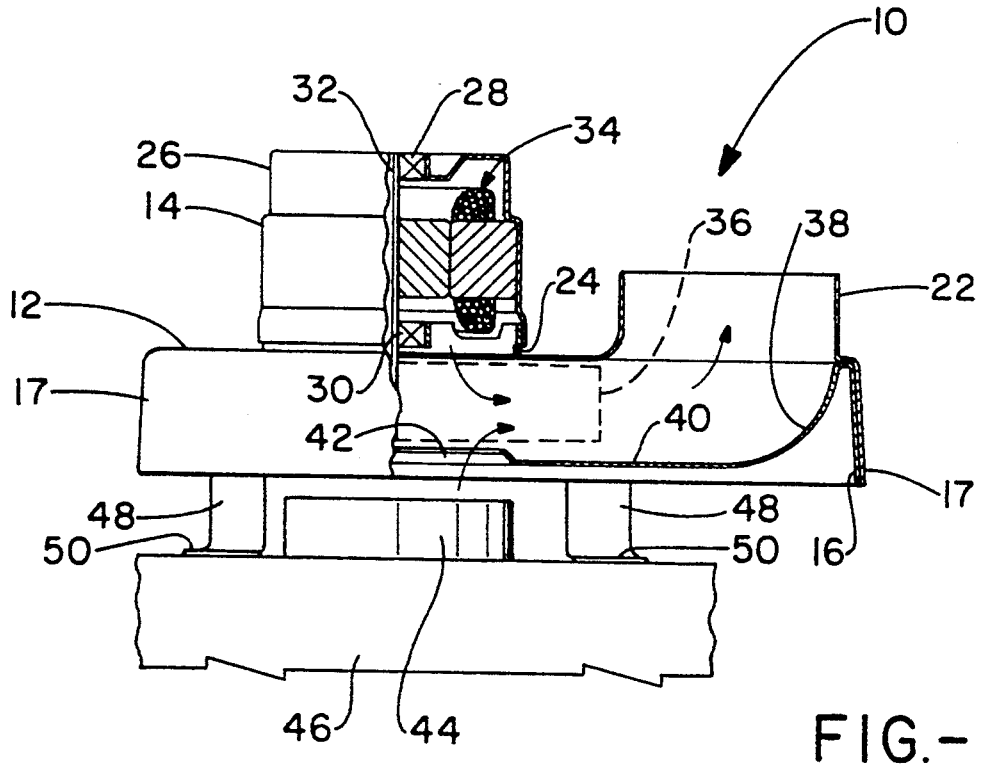
FIG. 2 is a front elevational view, in partial section, of the exhaust fan assembly of FIG. 1, illustratively showing the same maintained atop a hot water tank.

Referring now the drawing and more particularly FIGS. 1 and 2, it can be seen that an exhaust fan assembly adapted for implementation with the exhaust flue of a hot water tank is designated generally by the numeral 10. The exhaust fan assembly 10 includes a housing 12 receiving a motor cup 14 on a top side thereof and a cover 16 on a bottom side thereof. While it will be appreciated that the housing 12, motor cup 14, and cover 16 may be fabricated of any suitable material, it is preferred that such elements be of stamped steel, molded plastic, or the like to contain costs and improve efficiency.

In the preferred embodiment, the housing 12 is generally elliptical, having a major end portion 18 which is substantially semicircular in nature, having a radius on the order of 2.5"–4", and most preferably on the order of 3.3" or less. At the opposite end of the preferred housing 12, a minor end portion 20, also partially circular in nature, is provided. The radius of the minor end portion 20 is on the order of 1.25"–2.25", and preferably 1.75". In a preferred embodiment of the invention, the housing 12 is symmetrical about a line interconnecting the center points of the circular portions of the major end 18 and minor end 20. Additionally, it is preferred that the diameter of the major end portion 18 be less than the clearance between the inlet and outlet pipes of the associated hot water tank such that the exhaust fan assembly 10 may fit therebetween. Typically, a radius of 3.3" or less for the major end portion 18 will accommodate such a fit. It is contemplated, of course, that other geometric configurations may be used.

Extending upwardly from the housing 12 and molded as a portion thereof is an exhaust port 22. The exhaust port 22 is preferably tubular in nature and extends upwardly from the minor end portion 20, being generally concentric with the circular portion of the minor end portion 20. Also formed as part and parcel of the housing 12 is a lid 24 which raises from the top surface of the housing 12. The lid 24 is preferably circular in nature and concentric with the semicircular portion of the major end portion 18. The lid 24 serves to cap the otherwise open end of the motor cup 14 which is press fit onto the lid 24 as shown. An end bell 26 is formed as the top end portion of the motor cup 14, closing the end thereof opposite that receiving the lid 24. While in the preferred embodiment of the invention the end bell 26 is molded as an integral portion of the motor cup 14, it will appreciated that the same may be provided as a separate piece, press fit or otherwise attached thereto. A bearing 28 is received within a recess of the end bell 26 while a corresponding aligned bearing 30 is received within a recess of the lid 24. The aligned beatings 28, 30 are provided to receive and rotatably support the shaft 32 of the motor 34 which is received within the motor cup 14. In the preferred embodiment of the invention, the shaft 32 is coaxial with the central vertical axis of the major end portion 18.

A fan 36 is attached to the end of the shaft 32 on a side of the lid 24 opposite the motor 34. Actuation of the motor 34 causes the fan 36 to rotate, inducing a vacuum to move air in standard fashion.

It will be appreciated that the cover 16 is press fit or snap fit into and received by the side flange 17 of the housing 12, as best shown in FIG. 2. Of course, other means of attachment may be employed. As further shown, a radiused surface 38 is provided as part and parcel of the cover 16 to provide a smooth transition to the tubular exhaust port 22. Such arcuate or radiused surface 38 provides for smooth transition of flow for exhaust fumes or air driven by the fan 36 to the exhaust port 22. It will be appreciated that the cover 16 and housing 12 define a cavity therebetween within which the fan 36 rotates. The exhaust port 22 communicates with the cavity to provide for an exhaust of flue gases and air passing therethrough, while an input of such air and gases to the cavity is provided by means of an input aperture 42 within the flat plate portion 40 of the cover 16. In the preferred embodiment of the invention, the aperture 42 is aligned with the shaft 32 which is also in general alignment with the eye of the fan 36.

The aperture 42 is preferably positioned over and in alignment with the exhaust flue pipe 44 of a hot water tank 46, the same being illustratively shown in FIG. 2. Legs 48, attached to the housing 12, are provided with pads 50 for supporting receipt upon the top surface of the water heater tank 46. In the preferred embodiment of the invention, the pads 50 are maintained upon a circle having a center lying upon a line interconnecting the centers of the shaft 32 and the tubular exhaust port 22. Such positioning of the legs 48 and pads 50 accommodates the positioning of the exhaust fan assembly in various positions and orientations.

As best shown in FIG. 1, a plurality of apertures 52 pass through the end bell 26 of the motor cup 14 to provide for the introduction of motor cooling air from the ambient to the interior of the cup 14. Rotation of the fan 36 generates a draw through openings in the lid 24 such that the motor cooling air passes through the apertures 52, over the motor 34, through the lid 24, into the cavity between the housing 12 and cover 16, and out of the exhaust port 22. Accordingly, there is no requirement for a separate motor cooling fan. Additionally, as the motor cooling air mixes with the flue exhaust gases within the fan cavity, the temperature of the exhaust gases is further reduced before being passed out of the exhaust port 22 and into a connected plastic or PVC exhaust pipe.

With further attention to FIG. 1, it will be appreciated that the cylinder containing the fan 36 and the cylinder of the tubular exhaust port 22 do not intersect, but are separated from each other. Accordingly, the rotating fan 36 does not encroach upon the area of the exhaust port 22 or the transition area from the cavity to the exhaust port 22 as defined by the arcuate or radiused surface 38. Such separated structure provides for efficient operation of the fan 36 and the exhausting of the flue gases.

It will be further appreciated that it is contemplated that the aperture 42 may actually receive the flue pipe 44 therewithin such that the fan 36 draws directly from the flue pipe 44 in operation. However, a space may be provided between the aperture 42 and flue pipe 44 as shown in FIG. 2, allowing for the fan 36 to draw ambient air into the fan cavity along with the flue gases. Both types of communication between the exhaust fan assembly 10 and flue pipe 44 are contemplated within the context of the instant invention.

In operation, the motor 34 will typically be connected to an appropriate controller which serves to actuate the motor 34 when the burner of the hot water tank 46 is ignited, and for a short period thereafter. Rotation of the fan 36 within the cavity between the housing 12 and cover 16 generates a vacuum which draws the exhaust gases from the flue pipe 44, while also drawing motor cooling air through the motor cup 14. The flue gases and air are drawn into the fan cavity and exhausted across the arcuate surface 38 and out of the exhaust port 22 to a plastic or PVC exhaust pipe attached thereto.

Thus it can be seen that the objects of the invention have been satisfied by the structure presented above.

While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. An exhaust fan assembly for a water heater tank, comprising:

an elliptical casing having a first larger end and a second smaller end;

a fan received within said first end and rotatable about a first vertical axis over a flue pipe of the water heater tank;

an exhaust port extending from said second end about a second vertical axis; and a motor connected to said fan, said fan being interposed between, and axially aligned with, said motor and an intake aperture of said casing, said casing being spaced above said flue pipe and said fan drawing motor cooling air across said motor and exhaust gas from said flue pipe and passing said gas together out of said exhaust port.

2. The exhaust fan assembly according to claim 1, wherein said casing comprises a housing, a cover received at a bottom portion of said housing, and a motor cup received at a top portion of said housing, said motor cup receiving said motor.

3. The exhaust fan assembly according to claim 2, wherein said housing comprises a lid engaging a bottom portion of said motor cup, said lid maintaining a bearing receiving a shaft interconnecting said fan and said motor.

4. The exhaust fan assembly according to claim 3, wherein said exhaust port extends from said housing.

5. The exhaust fan assembly according to claim 4, wherein said cover defines a cavity with said housing, said cavity receiving said fan and communicating with said exhaust port.

6. The exhaust fan assembly according to claim 5, wherein said exhaust port is tubular and said fan rotates in a circle, said circle being spaced from and not intersecting any axial extension of said exhaust port.

7. The exhaust fan assembly according to claim 6, wherein said cover is characterized by said intake port and having an arcuate surface extending to said exhaust port.

8. An exhaust fan assembly for a hot water tank, comprising:

an elliptical housing positioned above a flue pipe of the hot water tank, said housing having legs extending therefrom and engaging a top surface of the hot water tank;

a fan received within said housing at a first end thereof, said fan being rotatable about a vertical axis when said housing is so positioned above a flue pipe;

an exhaust port extending from said housing at a second smaller end thereof opposite said first end; and a cup received by said housing, said Cup containing a motor connected to said fan, said cup having apertures in a first and thereof opposite a second end thereof adjacent said fan, said apertures providing for entry of motor cooling air into said cup, said motor cooling air being exhausted through said exhaust port wherein said fan is adapted to draw flue gases from the flue pipe and exhaust said flue gases through said exhaust port with said motor cooling air.

9. The exhaust fan assembly according to claim 1, further comprising a cover engaging a bottom portion of said housing, said cover and housing defining a cavity receiving said fan.

10. The exhaust fan assembly according to claim 9, wherein said cover defines an arcuate path from said cavity to said exhaust port.

11. The exhaust fan assembly according to claim 9, wherein said cover has an aperture therein, said aperture being coaxial with said fan.

12. The exhaust fan assembly according to claim 2, wherein said housing comprises a lid engaging said cup.

13. The exhaust fan assembly according to claim 12, wherein said cup is press fit onto said lid.

14. The exhaust fan assembly according to claim 13, wherein said cup and lid have respective bearings therein, said bearings receiving a shaft interconnecting said motor and fan.

15. The exhaust fan assembly according to claim 2, wherein said fan and said exhaust port define non-intersecting cylinders.

16. The exhaust fan assembly according to claim 1, wherein said legs extending from said housing for engagement with a top surface of the hot water tank lie on a common circle.

* * * * *